US005138731A

United States Patent [19]

Harcrow, Jr.

[11] Patent Number: 5,138,731

[45] Date of Patent: Aug. 18, 1992

[54] PERSON MOVEMENT ASSISTANCE APPLIANCE

[75] Inventor: Clyde N. Harcrow, Jr., Little Rock, Ark.

[73] Assignee: Beverly A. Heron, Little Rock, Ark.

[21] Appl. No.: 775,116

[22] Filed: Oct. 11, 1991

[51] Int. Cl.[5] ..... A61G 1/00

[52] U.S. Cl. ..... 5/625; 5/89.1; 5/627

[58] Field of Search ..... 5/496, 499, 81 R, 82 R, 5/83, 89, 625, 627

[56] References Cited

U.S. PATENT DOCUMENTS

| | | | |
|---|---|---|---|
| 1,697,633 | 1/1929 | Copeland | 5/499 |
| 3,284,816 | 11/1966 | Laubsch | 5/81 R |
| 3,364,506 | 6/1968 | Hale | 5/81 R |
| 3,829,914 | 8/1974 | Treat | 5/81 R |
| 4,092,748 | 6/1978 | Ewers | 5/82 R X |
| 4,606,290 | 8/1986 | Marzotto | 5/499 X |
| 4,675,925 | 6/1987 | Littleton | 5/81 R |

*Primary Examiner*—Michael F. Trettel
*Attorney, Agent, or Firm*—Ray F. Cox, Jr.

[57] ABSTRACT

This invention relates to an appliance to assist in the movement of persons. The appliance comprises a sheet of fabric material having sleeves along each longitudinal edge and each transverse edge. A plurality of handholds are provided along each longitudinal sleeve and each transverse sleeve. Means for securing the appliance to the upper surface of a mattress of a standard sized hospital bed are provided.

1 Claim, 1 Drawing Sheet

PERSON MOVEMENT ASSISTANCE APPLIANCE

TECHNICAL FIELD

This invention relates to an appliance for assisting in the movement of persons who are hospitalized, incapacitated or otherwise in need of assistance in being moved or transported from place to place, and for other related tasks as will be made clear in the following materials. Typical of the situations in which a person requires assistance in movement is that of a hospital patient. Hospital patients must be moved in order to change bed linen; they may require movement from one location to another as, for example, for surgery or for transport to locations where specialized testing or treatment equipment is available. Furthermore, a hospital patient is often required to be moved from a bed onto an apparatus for determining the patient's weight.

In the latter situation, the normal weighing apparatus is similar to the types set forth in U.S. Pat. No. 4,420,052 issued Nov. 13, 1984 to Laimins. A stretcher of fabric material contains longitudinal supporting bars along each edge. The stretcher is capable of being dismounted from the weighing machine. In normal use the patient must be rolled to one side of the bed, the stretcher is then placed onto the bed and the patient is rolled over one of the longitudinal supporting bars onto the center of the stretcher. The stretcher may then be attached to the weighing machine and the patient's weight determined. This method suffers from several disadvantages. First, the patient must be rolled to one side which could be uncomfortable and perhaps even dangerous for a patient who has, for example, recently undergone surgery. Furthermore the process of rolling the patient over the longitudinal supporting bar onto the stretcher provides an even greater degree of discomfort or danger to the patient. Finally, the excessive movement required to utilize this process also enhances the danger of IVs or similar devices attached to the patient being disturbed. Finally, as may readily be seen, the same process must be duplicated in reverse in order to return the patient to bed.

The preceding paragraph describes only one typical situation in which the movement of a hospital patient is likely to produce discomfort or actual danger to the patient. Furthermore, there is the possibility of hospital patients acquiring infections through the use of common appliances such as the stretcher described above.

The movement, transporting and repositioning of hospital patients is also a source of hazard to hospital staff. The movement of a hospital patient normally requires the services of numerous staff members due to the bulky and cumbersome nature of the human body. There is always a potential for back injuries in such circumstances. Consequently, it is desirable to provide an appliance for assisting in the movement of hospital patients that would eliminate or reduce the hazards described above. In addition, it is desirable to provide an appliance that can be flexibly adapted to numerous situations requiring the support, transport or movements of persons whether hospital patients or otherwise.

BACKGROUND OF PRIOR ART

A search of the prior art has failed to reveal any appliance of the type described herein and uniquely adapted to reduce or eliminate the hazards herein described.

SUMMARY OF THE INVENTION

The invention relates to a person movement assistance appliance. The appliance is in essence a sheet of fabric material of approximately the size and shape of the top of a standard sized hospital bed. The fabric material can be any of a number of compositions depending on the particular use to which the appliance is put. For example, use of the appliance in conjunction with a hospital patient weighing machine would indicate the use of a tear resistent material such as ripstop nylon. An appliance to be used in conjunction with surgical patients would best be composed of canvas type material that is sterilizable. An appliance used with burn patients or others susceptible to infections would require material of a bacteriostatic nature. Most appliances would also benefit from being constructed of water repellant material. This listing is not intended to be comprehensive but is illustrative of the types of materials that could be employed in the construction of the invention.

The appliance would normally be employed by placing it on a hospital bed under the uppermost sheet. The appliance would be fixed in position using means adapted to secure the appliance in position on the surface of the hospital bed. The means for securing the appliance could include elasticized straps which would pass partly or completely around the mattress of the hospital bed in order to secure the appliance in place. The means for securing the appliance could also include ties that would be capable of being affixed either to themselves after being passed around the mattress of the hospital bed or to immobile portions of the bed.

The appliance is provided with sleeves along each longitudinal edge and along each transverse edge. The sleeves are adapted for use in a variety of situations. For example, in order to weigh a hospital patient longitudinal supporting bars could be inserted into each longitudinal sleeve without disturbing the patient. Handholds are provided along each longitudinal sleeve. When properly sized and positioned on the appliance, these handhold openings could also be used as openings through which a standard type hospital weighing machine could be attached to the supporting bars allowing the patient to be weighed with minimal disturbance either to the patient or to indwelling lines, such as IVs or chest tubes. Upon completing the weighing process, the patient would simply be lowered to the surface of the bed, the means for securing the appliance to the bed reattached, the weighing machine disengaged from the longitudinal supporting bars and the longitudinal supporting bars withdrawn from the sleeves on the longitudinal edges of the appliance.

Similar supporting bars could be used in conjunction with the sleeves along the transverse edges of the appliance. In addition, the appliance is provided with handholds as indicated along the longitudinal edges and also along the transverse edges. By positioning handholds along all four edges of the appliance, the task of moving, repositioning or transporting a patient can be greatly simplified resulting in less danger and discomfort to the patient and greater ease and flexibility of use for the hospital staff.

The appliance also embodies various other advantages by using a single appliance for each patient. The possibilities of cross-contamination of patients would be greatly reduced. The appliance would provide extra protection of the bed's mattress from soiling and due to the unique arrangement of handholds, sleeves and securing means, the appliance is flexibly adaptable to use in a variety of environments.

Furthermore, as is commonly done in hospitals with individual egg crate mattresses, the appliance could be taken home by the hospital patient where the same degree of flexible adaptability could allow the appliance to be employed in a number of ways. For example, the appliance could be employed as a ground cloth for use with sleeping bags. The appliance could also be adapted for use as a hammock or a camp bed. In emergency situations, the appliance could be used as an emergency stretcher.

BRIEF DESCRIPTION OF THE DRAWING

The details of the invention will be described in connection with the accompanying drawings in which.

DESCRIPTION OF THE PREFERRED EMBODIMENT

Figure 1:
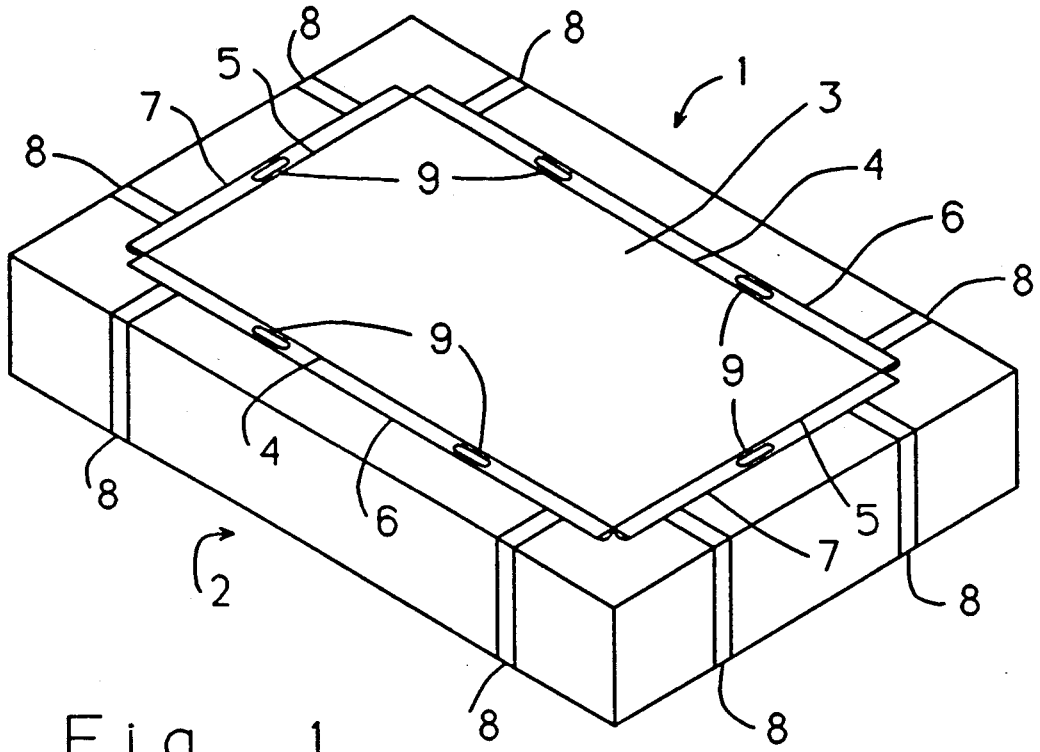
FIG. 1 is a perspective view illustrating the appliance in position on the surface of a standard sized hospital bed mattress.
Figure 2:
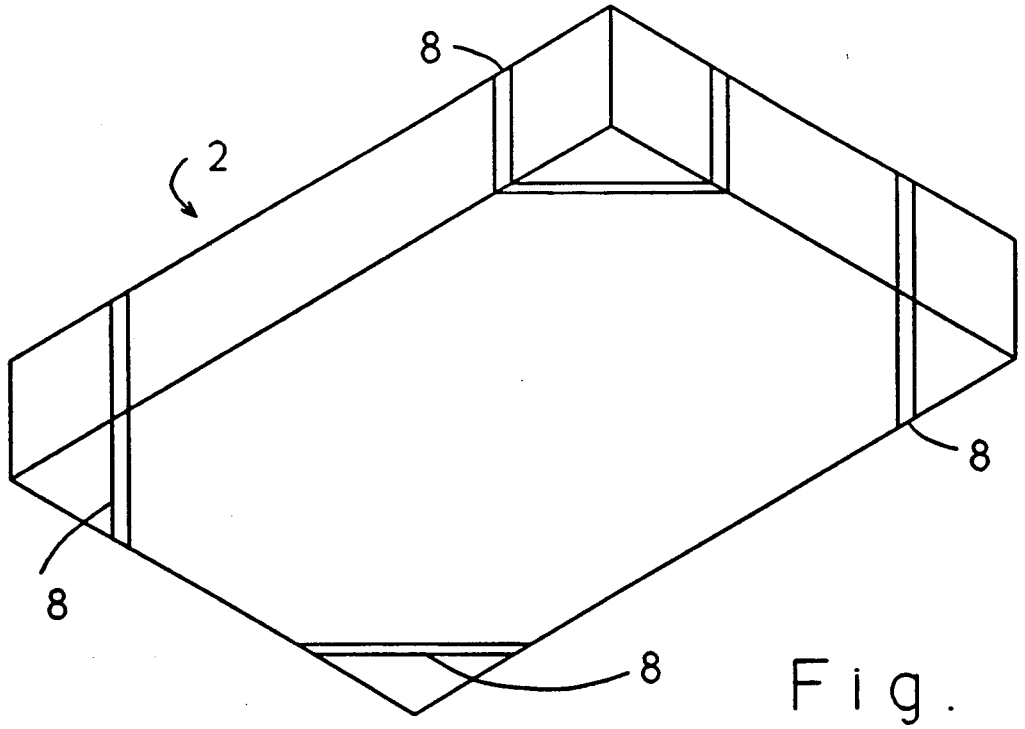
FIG. 2 is a view of the underside of the mattress showing a typical method of securing the appliance to a hospital bed mattress through the use of elasticized straps.

As illustrated in FIGS. 1 and 2 a personal movement assistance appliance generally designated by the numeral 1 is provided for use in conjunction with a standard sized hospital bed. For the sake of clarity, the structure of the hospital bed is omitted. The mattress of said hospital bed is generally designated by the numeral 2. The appliance is constructed of a sheet of fabric material 3. The fabric material may be any of a number of suitable materials, such as ripstop nylon, canvas, bacteriostatic materials, water repellant materials or other types of materials not specifically mentioned herein. The sheet 3 comprises both a pair of longitudinal edges 4 and transverse edges 5. The longitudinal edges 4 and the transverse edges 5 include respectively longitudinal sleeves 6 and transverse sleeves 7 which are adapted to receive supporting bars or poles which could include supporting bars of the type described above in conjunction with hospital patient weighing machines.

The method by which the longitudinal sleeve 6 and the transverse sleeve 7 are formed is not significant to the essence of this invention. However, such sleeves can be readily formed by a doubling over of the fabric material of the sheet 3 and affixing the longitudinal edges 4 and the transverse edges 5 to the sheet 3. This example, however, is not by way of limitation and any other method or process for forming the longitudinal sleeve 6 and the transverse sleeves 7 consistent with the object of the invention would be within the scope of this invention.

The invention is furthermore provided with a plurality of handholds 9. The handholds 9 are positioned along the longitudinal sleeves 6 and the transverse sleeves 7 and aligned with said longitudinal sleeves 6 and transverse sleeves 7. The number and placement of handholds 9 may be adjusted as necessary for particular applications. If a primary application of the invention is in conjunction with a hospital weighing machine, the placement of the handholds 9 along the longitudinal sleeves 6 should be such as to facilitate the attachment of a weighing machine to longitudinal supporting bars inserted through the longitudinal sleeves 6. The handholds 9 may be simply comprised of approximately hand sized openings through the longitudinal sleeves 6 and the transverse sleeves 9.

In ordinary use the appliance would be placed on the upper surface of the mattress 2 of a hospital bed. The appliance would then normally be covered with the uppermost sheet of the hospital bed. In order to firmly affix the appliance to the surface of the mattress 2, means for securing the appliance to the hospital bed are provided. In the preferred embodiment a plurality of elasticized straps 8 are attached to the appliance. The elasticized straps 8 fit around each corner of the mattress 2 in order to firmly secure the appliance to the upper surface of the mattress. In an alternative embodiment the means for securing the appliance to the hospital bed would comprise a plurality of ties which would be affixed to the appliance and capable of being passed partly or completely around the mattress so as to be capable of being affixed to themselves or to immobile portions of the hospital bed.

It should be understood that various modifications in the preferred embodiment of the invention as described above may be made without departing from the scope of the invention as defined in the following claims.

What is claimed is:

1. A person movement assistance appliance, comprising:

(a) a sheet of fabric material of sufficient strength and resistance to tearing as to be capable of safely supporting the weight of a person when lifted, moved or suspended on said sheet, said sheet having approximately the dimensions of the surface of a standard sized hospital bed, said sheet having a pair of longitudinal edges and a pair of transverse edges; and (b) a pair of longitudinal sleeves, one along each side of said longitudinal edges;

(c) one or more handholds on each of said longitudinal sleeves, said handholds comprising approximately hand-sized openings through said longitudinal sleeves and aligned therewith;

(d) means for securing said person movement assistance appliance to the upper surface of a standard hospital bed, comprising a plurality of elasticized straps attached to said appliance and capable of being passed partially or completely around the mattress of said hospital bed;

(e) a pair of transverse sleeves, one along each of said transverse edges; and (f) one or more handholds on each of said transverse sleeves, said handholds comprising approximately hand-sized openings through said transverse sleeves and aligned therewith.

* * * * *